US006273063B1

(12) United States Patent
Saruwatari et al.

(10) Patent No.: US 6,273,063 B1
(45) Date of Patent: Aug. 14, 2001

(54) APPARATUS AND METHOD FOR CONTROLLING IDLE ROTATION SPEED OF AN INTERNAL COMBUSTION ENGINE

(75) Inventors: Masayuki Saruwatari; Junichi Furuya, both of Atsugi (JP)

(73) Assignee: Unisia Jecs Corporation, Atsugi (JP)

( * ) Notice: Subject to any disclaimer, the term of this patent is extended or adjusted under 35 U.S.C. 154(b) by 0 days.

(21) Appl. No.: 09/527,242

(22) Filed: Mar. 17, 2000

(30) Foreign Application Priority Data

Mar. 19, 1999 (JP) ..... 11-076604

(51) Int. Cl.[7] ..... F02D 41/16
(52) U.S. Cl. ..... 123/339.21
(58) Field of Search ..... 123/339.19, 339.21, 123/339.23

(56) References Cited

U.S. PATENT DOCUMENTS 5,215,055 * 6/1993 Orzel ..... 123/339.23
5,228,421 * 7/1993 Orzel ..... 123/339.12

FOREIGN PATENT DOCUMENTS 7-139398 5/1995 (JP) .
11-93736 4/1999 (JP) .
11-182360 7/1999 (JP) .

* cited by examiner

*Primary Examiner*—Andrew M. Dolinar
(74) *Attorney, Agent, or Firm*—Foley & Lardner

(57) ABSTRACT

When canister purge is started during feedback control of idle rotation speed, a feedback control value for immediately prior to starting purge is stored, and when purge is stopped, the feedback operating amount is changed stepwise up to the stored value.

20 Claims, 3 Drawing Sheets

APPARATUS AND METHOD FOR CONTROLLING IDLE ROTATION SPEED OF AN INTERNAL COMBUSTION ENGINE

FIELD OF THE INVENTION

The present invention relates to an apparatus and method for controlling idle rotation speed of an internal combustion engine. In particular the invention relates to technology in an internal combustion engine equipped with a fuel vapor treatment unit, for feedback controlling engine rotation speed to a target rotation speed at the time of idle operation.

RELATED ART OF THE INVENTION

Heretofore there is known a fuel vapor treatment apparatus which is furnished with; a canister provided with active carbon for absorbing and retaining fuel vapor generated in a vehicle fuel tank, purge piping which supplies fuel purged from the canister to an engine intake passage using the negative intake pressure of the engine, and a purge control valve disposed in the purge piping, the construction being such that an amount of purge gas supplied to the engine is adjusted by controlling the purge control valve depending on the engine operating conditions (refer to Japanese Unexamined Patent Publication No. 11-182360).

Furthermore, there is known an idle rotation speed control apparatus which compares an actual engine rotation speed with a target rotation speed and feedback controls an engine intake air quantity in order to make the engine rotation speed at the time of engine idle operation coincide with the target rotation speed (refer to Japanese Unexamined Patent Publication No. 11-093736).

When purging is performed at the time of idle operating conditions and open control conditions of air-fuel ratio, the torque generated in the engine increases due to the rich shift in the air-fuel ratio. However, with a feedback control of the idle rotation speed, the engine intake air quantity is decreased in order to suppress a rise in rotation speed as a result of the increased torque.

When in such a purge condition the purging is stopped, the air-fuel ratio becomes leaner and returns to the vicinity of the original target air-fuel ratio. However, since the intake air quantity at that time has a low value in conformity with the purge condition, there has been a problem in that until this intake air quantity is increasingly changed to a value conforming to the purge stopped condition, the idle rotation speed decreases.

In particular, in engines in which the target air-fuel ratio during the idle operation condition becomes far leaner than the theoretical air-fuel ratio, there is the problem of a significant influence of the rich shift caused by purging, and an even greater change in rotation speed when purging is stopped.

SUMMARY OF THE INVENTION

The present invention has takes into consideration the abovementioned problems, with the object of providing an idle rotation speed control apparatus which can suppress the lowering of the idle rotation speed when purging is stopped.

In order to achieve the above object, the present invention is constructed such that a feedback control of the idle rotation speed in the purge stopped condition, and a feedback control of the idle rotation speed in the purge execution condition, are carried out separately.

Moreover, the construction is such that when purge is started during the feedback control of the idle rotation speed, an operating amount for immediately prior to starting purge is stored, and then when purge is stopped, an initial value of the operating amount for control in the purge stopped condition is made a final value in the stored purge stopped condition for the previous time, and the feedback control for the purge stopped condition is restarted from this initial value.

On the other hand, the construction is such that when purge is started during the feedback control of the idle rotation speed, the operating amount for immediately prior to starting purge is stored, and when the purge is stopped, the operating amount computed during purging is forcibly shifted to the beforementioned stored operating amount in the purge stopped condition.

Other objects and aspects of this invention will become apparent from the following description of the embodiment, in association with the appended drawings.

DESCRIPTION OF THE PREFERRED EMBODIMENTS

Figure 1:
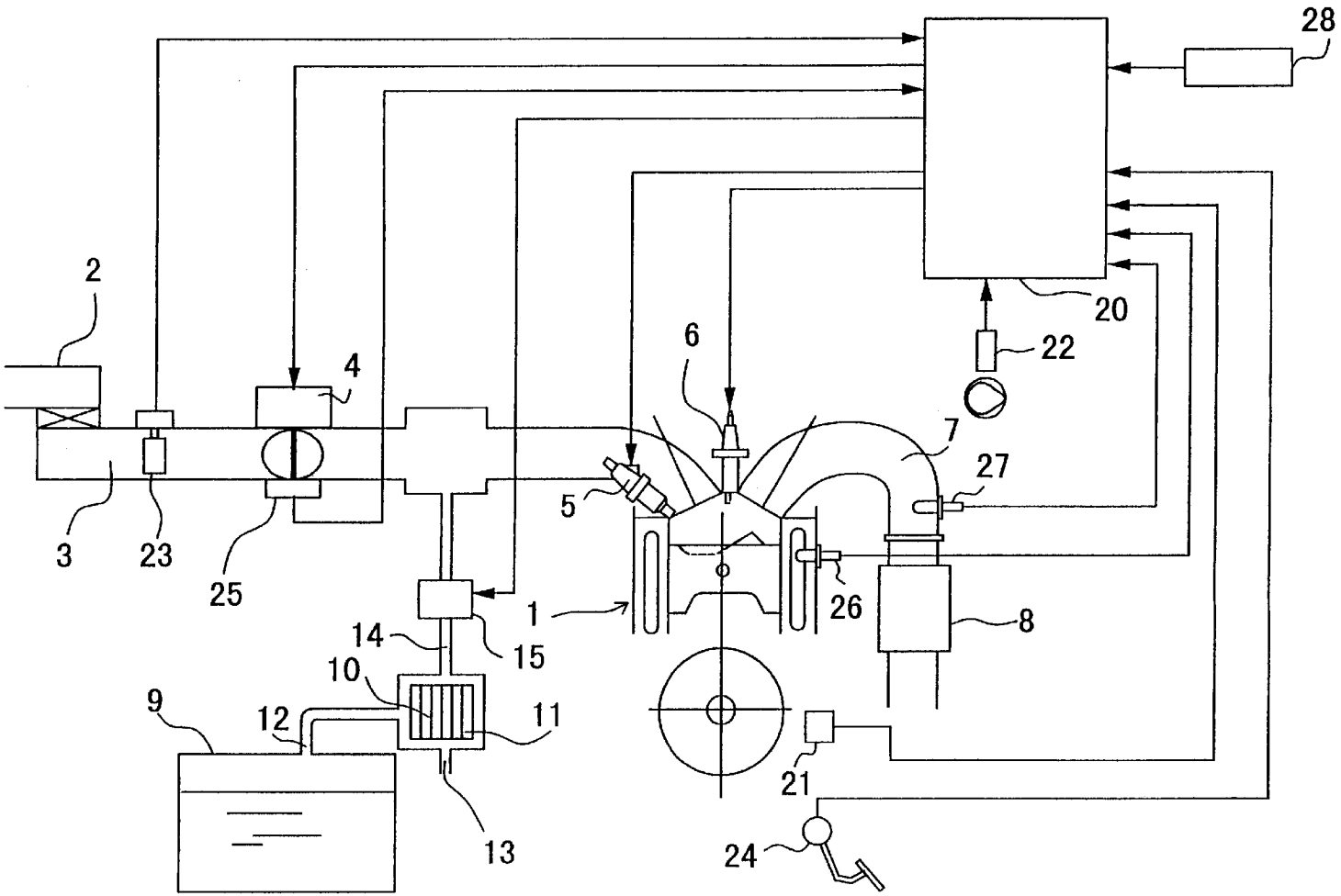
FIG. 1 is a system configuration diagram of an internal combustion engine of an embodiment.

FIG. 1 is a system configuration diagram of an internal combustion engine of an embodiment.

In FIG. 1, with regard to a combustion chamber of each cylinder of an internal combustion engine 1 mounted on a vehicle, air is drawn in to each cylinder through an air cleaner 2, an intake passage 3 and an electronically controlled throttle valve 4.

The electronically controlled throttle valve 4 is driven to open and close by control of an actuator.

Also, an electromagnetic fuel injection valve 5 is provided so that fuel (gasoline) is directly injected into the combustion chamber of each cylinder.

The fuel injection valve 5 is opened by an injection pulse signal output during an intake stroke or a compression stroke of each cylinder from a control unit 20, to inject fuel adjusted to a predetermined pressure.

After this, the fuel injected from the fuel injection valve 5 in the intake stroke disperses in the combustion chamber where it forms a homogenous air-fuel mixture, or the fuel which is injected from the fuel injection valve 5 in the compression stroke forms a stratified air-fuel mixture which concentrates around an ignition plug 6. The air fuel mixture is spark ignited by the ignition plug 6 which is controlled based on an ignition signal from the control unit 20, to be combusted.

It should be noted that depending on the combination with the target air-fuel ratio, the combustion method can be either homogenous stoichiometric combustion, homogenous lean combustion (air-fuel ratio=20~30), or stratified lean combustion (air-fuel ratio=approximately 40).

However, the internal combustion engine 1 is not restricted to the abovementioned direct injection type gasoline engine, but may also be an engine which is constructed so that fuel is injected into the intake port.

The exhaust from the engine 1 is discharged through an exhaust passage 7. A catalytic converter 8 for exhaust purification is disposed in the exhaust passage 7.

Also, a fuel vapor treatment apparatus is provided for treating fuel vapor which is generated in a fuel tank 9.

A canister 10, which constitutes the fuel vapor treatment apparatus, is a closed container which is filled with adsorbing agents 11 such as active carbon, and is connected to the fuel tank 9 by means of a fuel vapor inlet pipe 12. As a result of this, fuel vapor which is generated in the fuel tank 9 while the engine 1 is stopped, is introduced into the canister 10 through the fuel vapor inlet pipe 12, where it is adsorbed and retained.

Moreover, a fresh air inlet 13 is formed in the canister 10, and purge piping 14 leads out from the canister 10.

A purge control valve 15 which is open/close controlled by means of control signals from the control unit 20, is disposed in the purge piping 14.

With the above construction, when the purge control valve 15 is controlled to open, fuel vapor which has been adsorbed by the absorbing agent 11 in the canister 10 is purged by air which is introduced from the fresh air inlet 13, as a result of the negative intake pressure of the engine 1 acting on the canister 10. This purged gas then passes through the purge piping 14 and is drawn into the intake passage 3 downstream of the throttle valve 4, and then burned in the combustion chamber of the engine 1.

The control unit 20 incorporates a microcomputer which includes a CPU, a ROM, a RAM, an A/D converter, an input/output interface and the like. The control unit 20 takes the input of detection signals from various kinds of sensors, and controls the fuel injection valve 5, the ignition plug 6, and the purge control valve 15 and the like, by computational processing based on these detection signals.

For the various sensors there is provided a crank angle sensor 21 for detecting the rotation of crankshaft of the engine 1, and a cam sensor 22 for detecting the rotation of camshaft of the engine 1.

These sensors 21 and 22 output a reference pulse signal REF at a previously determined crank angle position (for example 110° before compression top dead center) each time the crank angle is 720°/n, with n being the number of cylinders, and output a unit pulse signal POS for each 1~2°, and are thus able to compute the engine rotation number Ne from the period or the like of the reference pulse signal REF.

In addition to this, there is provided; an air flow meter 23 for detecting an intake air quantity upstream of the throttle valve 4, an accelerator sensor 24 for detecting a depressing amount APS of an accelerator pedal (accelerator opening), a throttle sensor 25 for detecting an opening TVO of the throttle valve 4, a water temperature sensor 26 for detecting the cooling water temperature Tw of the engine 1, an oxygen sensor 27 for outputting a signal indicating the rich/lean of the exhaust air-fuel ratio with respect to a theoretical air-fuel ratio, and a vehicle speed sensor 28 for detecting vehicle speed VSP.

The construction is such that when a target air-fuel ratio is a theoretical air-fuel ratio, and when other conditions are established, an air-fuel ratio feedback control for correcting the fuel injection quantity is carried out to make the exhaust air-fuel ratio detected by the oxygen sensor 27 coincide with the theoretical air-fuel ratio.

Here the construction is such that the target air-fuel ratio in an engine idle operation condition is set leaner than the theoretical air-fuel ratio. In the idle operation condition, the air-fuel ratio feedback control is thus made an open control condition.

Moreover with the control unit 20, in the idle operation condition of the engine 1, the target idle rotation speed is set depending on the cooling water temperature or the like, and the throttle valve 4 opening (intake air quantity) is feedback controlled by integral control, based on deviation between an actual engine rotation speed and the target idle rotation speed. The function of this control unit 20 corresponds to a feedback device or a feedback means.

However, the construction may be such that for the throttle valve there is provided a mechanical throttle valve which is driven to open and close by linking to the accelerator pedal, and moreover there is provided a bypass passage for bypassing the mechanical throttle valve, and the opening of an idle control valve disposed in the bypass passage is feedback controlled so that the actual engine rotation speed coincides with the target idle rotation speed.

Here, aspects of the feedback control for the idle rotation speed will be explained following the flow chart in FIG. 2.

Figure 2:
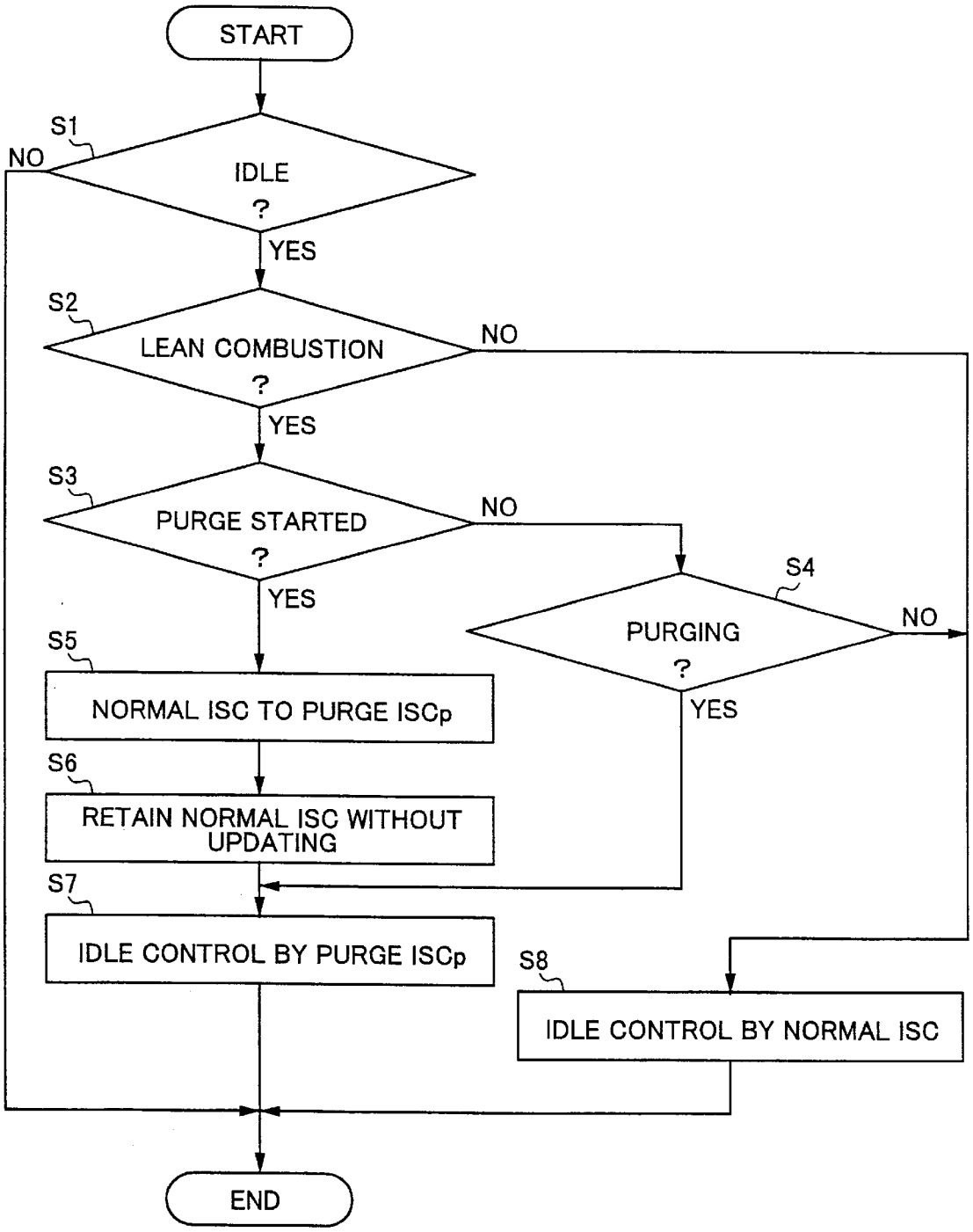
FIG. 2 is a flow chart showing a feedback control of idle rotation speed of the embodiment.

In the flow chart of FIG. 2, in step S1 it is judged if the engine 1 is in an idle operation condition. The function of step S1 corresponds to an idle detection device or an idle detection means.

Then in the case of no idle operation condition the routine is terminated as is. However, if there is an idle operation condition control proceeds to step S2.

In step S2, it is judged if the target air-fuel ratio is leaner than the theoretical fuel air ratio, and hence if there is a lean combustion condition.

When not a lean combustion condition, control proceeds to step S8 where, based on the deviation between the engine rotation speed at that time and the target idle rotation speed, a feedback correction amount ISC (first operating amount) of the opening operating amount of the throttle valve 4 is integral controlled, and the opening (intake air quantity) of the throttle valve 4 is controlled by the feedback correction amount ISC.

The function of step S8 corresponds to a first feedback device, or a feedback device and feedback means.

Moreover, when in an idle operation condition and there is a lean combustion condition, control proceeds to step S3 where it is judged if it is start time for purge.

When not start time for purge, control proceeds to step S4 where it is judged if purging is underway. If purge is not underway control proceeds to step S8 where the feedback correction amount ISC is integral controlled based on the deviation between the engine rotation speed at that time and the target idle rotation speed.

The functions of step S3 and step S4 correspond to a purge judgment device or a purge judgment means.

When purge is started from a non-purge condition, control proceeds from step S3 to step S5, where the value of the feedback correction amount ISC at that time is set to a feedback correction amount ISCp (second operating amount) for computation under purge conditions. The purge feedback correction amount ISCp is computed with the feedback correction amount ISC immediately prior to starting purge as an initial value.

The function of step S5 corresponds to an initial value setting device.

Moreover, in the following step S6, during purging the feedback correction amount ISC is not updated, with setting being performed for retaining the value at the time of starting purge, and the feedback correction amount ISC at the point when purge starts is stored.

The function of step S6 corresponds to a storage device or a storage means.

Following this, control proceeds to step S7 where the purge feedback correction amount ISCp which has the value of the feedback correction amount ISC at the time of starting purge as the initial value, is integral controlled based on the deviation between the engine rotation speed at that time and the target idle rotation speed. The idle rotation speed during purge is then controlled to the target idle rotation speed by controlling the opening (intake air quantity) of the throttle valve 4 using the purge feedback correction amount ISCp instead of the feedback correction amount ISC.

The function of step S7 corresponds to a second feedback device, or a feedback device and a feedback means.

In the above manner, during purge the value of the feedback correction amount ISC is retained at the value at the time of starting purge, while the purge feedback correction amount ISCp is update computed to be controlled to the target idle rotation speed. However when the purge is stopped, control proceeds from step S4 to step S8 so that the operating amount is forcibly shifted from the purge feedback correction amount ISCp to the feedback correction amount ISC, whereby the idle rotation speed is controlled at the target idle rotation speed.

Here since at the time of starting purge, updating of the feedback correction amount ISC is stopped, and the value at the time of starting purge is stored and retained, then the value of the feedback correction amount ISC at the time of stopping purge and switching from the purge feedback correction amount ISCp to the feedback correction amount ISC becomes the value at the time of starting purge. This function corresponds to an initial value setting device, or to a shift device and a shift means.

Figure 3:
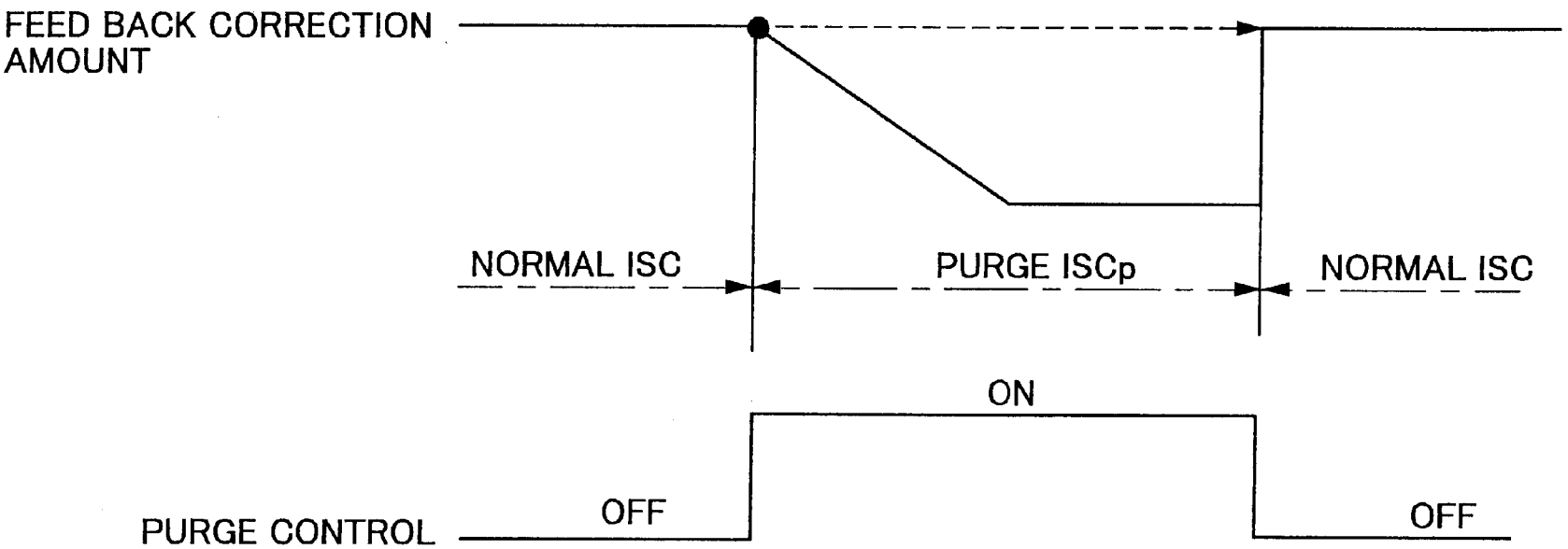
FIG. 3 is a time chart showing characteristics of the feedback control of the idle rotation speed of the embodiment.

In other words, as shown in FIG. 3, when the air-fuel ratio becomes richer after starting purge so that the torque generated in the engine increases and the idle rotation speed tends to speed up, the purge feedback correction amount ISCp (second operating amount) is updated in order to suppress this rise in this idle rotation speed by reduction correction of the intake air quantity. However during this time the feedback correction amount ISC (first operating amount) is stored and retained at the value at the time of starting purge.

Following this, when the purge is stopped, switch over is made from the purge feedback correction amount ISCp to the feedback correction amount ISC which has been stored and retained. However, since this stored and retained value is a value appropriate for the purge stopped condition, it is possible to control from immediately after stopping purge, to an appropriate intake air quantity suitable for the purge stopped condition.

In the case where the aforementioned control is not made, when the purge is stopped and the idle rotation speed tends to decrease because the air-fuel ratio becomes leaner, the intake air quantity is gradually increased by integral control, but due to a delay in this control response a temporary fall in rotation speed is produced. However, if the construction is such that as mentioned above, when the purge is stopped the feedback correction amount ISC is changed stepwise to a set value which is appropriate to the purge stopped condition, it is possible to control to an intake air quantity amount appropriate for the approximate purge stopped condition, so that fluctuations in rotation speed when the purge is stopped can be suppressed With the abovementioned embodiment the construction is such that the purge feedback correction amount ISCp and the feedback correction amount ISC are computed separately. However, the construction may be such that also during purging the feedback correction amount ISC is updated and used in the control of the intake air quantity. Moreover the construction may be such that the feedback correction amount ISC at the time of starting purge is stored, and the feedback correction amount ISC is changed stepwise to the value which was stored when purge was stopped.

What we claimed are:

1. An apparatus for controlling idle rotation speed of an internal combustion engine equipped with a fuel vapor treatment unit constructed so as to adsorb and retain in a canister, fuel vapor generated in a fuel tank, and supply fuel purged from the canister to an engine intake system, said apparatus comprising:

an idle detection device for detecting an idle operating condition of the engine;

a purge judgment device for judging if purge is being performed;

a first feedback device for computing at the time of said idle operating condition and purge stopped condition, a first operating amount for controlling an engine intake air quantity so that an idle rotation speed of the engine coincides with a target idle rotation speed, and controlling the engine intake air quantity based on said first operating amount; and a second feedback device for computing at the time of said idle operating condition and purge execution condition, a second operating amount for controlling an engine intake air quantity so that an idle rotation speed of the engine coincides with a target idle rotation speed, and controlling the engine intake air quantity based on said second operating amount.

2. An apparatus for controlling idle rotation speed of an internal combustion engine according to claim 1, wherein there is provided;

a storage device for storing said first operating amount for immediately prior to starting purge, when purge is started during control by said first feedback device, and an initial value setting device for setting said first operating amount for immediately prior to starting purge which is stored in said storage device to an initial value of said first operating amount, when said first feedback device restarts control due to purge stopping.

3. An apparatus for controlling idle rotation speed of an internal combustion engine according to claim 2, wherein said idle operating condition is an idle operating condition where a target air-fuel ratio for a combustion mixture of the engine is set to leaner than a theoretical air-fuel ratio.

4. An apparatus for controlling idle rotation speed of an internal combustion engine according to claim 1, wherein there is provided;

an initial value setting device for setting said first operating amount for immediately prior to starting purge to an initial value of said second operating amount for said second feedback device, when purge is started during control by said first feedback device.

5. An apparatus for controlling idle rotation speed of an internal combustion engine according to claim 1, wherein said first and second feedback devices compute said operating amounts by integral control based on deviation between the engine idle rotation speed and the target idle rotation speed.

6. An apparatus for controlling idle rotation speed of an internal combustion engine according to claim 1, wherein said first and second feedback devices compute an operating amount of a throttle valve opening as said operating amount.

7. An apparatus for controlling idle rotation speed of an internal combustion engine equipped with a fuel vapor treatment unit constructed so as to adsorb and retain in a canister, fuel vapor generated in a fuel tank, and supply fuel purged from the canister to an engine intake system, said apparatus comprising:

an idle detection device for detecting an idle operating condition of the engine;

a purge judgment device for judging if purge is being performed; a feedback device for computing, in said idle operating condition, an operating amount for controlling an engine intake air quantity so that an idle rotation speed of the engine coincides with a target idle rotation speed, and controlling the engine intake air quantity based on said operating amount;

a storage device for storing said operating amount for immediately prior to starting purge, when said purge is started during control by said feedback device; and a shift device for forcefully shifting said operating amount up to the operating amount for immediately prior to starting purge which is stored in said storage device, when said purge is stopped during control by said feedback device.

8. An apparatus for controlling idle rotation speed of an internal combustion engine according to claim 7, wherein said idle operating condition is an idle operating condition where a target air-fuel ratio for a combustion mixture of the engine is set to leaner than a theoretical air-fuel ratio.

9. An apparatus for controlling idle rotation speed of an internal combustion engine according to claim 7, wherein said feedback device computes said operating amount by integral control based on deviation between the engine idle rotation speed and the target idle rotation speed.

10. An apparatus for controlling idle rotation speed of an internal combustion engine according to claim 7, wherein said feedback device computes an operating amount of a throttle valve opening as said operating amount.

11. An apparatus for controlling idle rotation speed of an internal combustion engine equipped with a fuel vapor treatment unit constructed so as to adsorb and retain in a canister, fuel vapor generated in a fuel tank, and supply fuel purged from the canister to an engine intake system, said apparatus comprising:

idle detection means for detecting an idle operating condition of the engine;

purge judgment means for judging if purge is being performed;

feedback means for computing, in said idle operating condition, an operating amount for controlling an engine intake air quantity so that an idle rotation speed of the engine coincides with a target idle rotation speed, and controlling the engine intake air quantity based on said operating amount;

storage means for storing said operating amount for immediately prior to starting purge, when said purge is started during control by said feedback means; and shift means for forcibly shifting said operating amount up to the operating amount for immediately prior to starting purge which is stored in said storage means, when said purge is stopped during control by said feedback means.

12. A method of controlling idle rotation speed of an internal combustion engine equipped with a fuel vapor treatment unit constructed so as to adsorb and retain in a canister, fuel vapor generated in a fuel tank, and supply fuel purged from the canister to an engine intake system, said method comprising the steps of:

detecting an idle operating condition of the engine;

computing, in said idle operating condition, an operating amount for controlling an engine intake air quantity so that an idle rotation speed of the engine coincides with a target idle rotation speed;

controlling the engine intake air quantity based on said operating amount;

storing said operating amount for immediately prior to starting purge; and forcibly shifting said operating amount up to said stored operating amount for immediately prior to starting purge, when said purge is stopped.

13. A method of controlling idle rotation speed of an internal combustion engine according to claim 12, wherein said step of detecting an idle operating condition detects an idle operating condition where a target air-fuel ratio for a combustion mixture of the engine is set to leaner than a theoretical air-fuel ratio.

14. A method of controlling idle rotation speed of an internal combustion engine according to claim 12, wherein said step of computing an operating amount computes said operating amount by integral control based on deviation between the engine idle rotation speed and the target idle rotation speed.

15. A method of controlling idle rotation speed of an internal combustion engine according to claim 12, wherein said step of controlling an engine intake air quantity controls a throttle valve opening based on said operating amount.

16. A method of controlling idle rotation speed of an internal combustion engine equipped with a fuel vapor treatment unit constructed so as to adsorb and retain in a canister, fuel vapor generated in a fuel tank, and supply fuel purged from the canister to an engine intake system, said method comprising the steps of:

detecting an idle operating condition of the engine;

judging if purge is being performed;

computing at the time of said idle operating condition and purge stopped condition, a first operating amount for controlling an engine intake air quantity so that an idle rotation speed of the engine coincides with a target idle rotation speed;

controlling the engine intake air quantity based on said first operating amount;

computing at the time of said idle operating condition and purge execution condition, a second operating amount for controlling an engine intake air quantity so that an idle rotation speed of the engine coincides with a target idle rotation speed;

controlling the engine intake air quantity based on said second operating amount;

storing said first operating amount for immediately prior to starting purge, when purge is started during control based on said first operating amount; and setting said stored first operating amount for immediately prior to starting purge to an initial value of said first operating amount, when control based on said first operating amount is restarted accompanying purge stopping.

17. A method of controlling idle rotation speed of an internal combustion engine according to claim 16, wherein said step of detecting an idle operating condition detects an idle operating condition where a target air-fuel ratio for a combustion mixture of the engine is set to leaner than a theoretical air-fuel ratio.

18. A method of controlling idle rotation speed of an internal combustion engine according to claim 16, wherein said step of computing a first operating amount and said step of computing a second operating amount, compute said operating amounts by integral control based on deviation between the engine idle rotation speed and the target idle rotation speed.

19. A method of controlling idle rotation speed of an internal combustion engine according to claim 16, wherein there is provided;

a step of setting said first operating amount for immediately prior to starting purge to an initial value of said second operating amount, when purge is started during control based on said first operating amount.

20. A method of controlling idle rotation speed of an internal combustion engine according to claim 16, wherein said step of controlling an engine intake air quantity based on said first operating amount, and said step of controlling an engine intake air quantity based on said second operating amount, control a throttle valve opening based on said operating amounts.

* * * * *